United States Patent [19]

Bernardini

[11] Patent Number: 4,955,821

[45] Date of Patent: Sep. 11, 1990

[54] METHOD FOR CONTROLLING CONNECTOR INSERTION OR EXTRACTION SEQUENCE ON POWER DISTRIBUTION PANEL

[75] Inventor: Allen J. Bernardini, Southbury, Conn.

[73] Assignee: Litton Systems, Inc., Watertown, Conn.

[21] Appl. No.: 377,118

[22] Filed: Jul. 10, 1989

[51] Int. Cl.[5] ..... H01R 13/44

[52] U.S. Cl. ..... 439/133; 439/142; 439/299; 439/924

[58] Field of Search ..... 439/133, 134, 135, 136, 439/299, 300, 312, 332, 333, 334, 338, 677, 911, 924, 142

[56] References Cited

U.S. PATENT DOCUMENTS

| | | | |
|---|---|---|---|
| 4,542,946 | 9/1985 | Snow | 439/137 X |
| 4,767,347 | 8/1988 | Kamp et al. | 439/133 |
| 4,845,593 | 7/1989 | Brown et al. | 439/133 X |

*Primary Examiner*—Neil Abrams
*Assistant Examiner*—Khiem Nguyen
*Attorney, Agent, or Firm*—Brian L. Ribando

[57] ABSTRACT

A coupling guard insures that a plurality of plugs are coupled to plural receptacles in a desired sequence. An array of cam rings which rotate in unison with the rotation of mating plugs are designed to be locked against rotation unless the rings are rotated in the desired sequence. In one embodiment, cover plates coupled to the cam rings cover the entrance to the adjacent receptacles and are removed from the entrance of the receptacles by rotation of the cam rings.

20 Claims, 3 Drawing Sheets

METHOD FOR CONTROLLING CONNECTOR INSERTION OR EXTRACTION SEQUENCE ON POWER DISTRIBUTION PANEL

BACKGROUND OF THE INVENTION

The invention relates to a sequential coupling guard which insures that a plurality of electrical plugs are connected to a plurality of electrical receptacles in a predetermined sequence.

Plug and receptacle type connectors are well known in the art. When connecting a number of plugs to receptacles, operator safety requires connecting the plugs to the ground and neutral receptacles before connecting other plugs to the power phase receptacles. Once all of the plugs have been connected to the receptacles, operator safety also requires disconnecting the power plugs before the neutral and the ground plugs. Although the power, ground, and neutral plugs may be differently sized and shaped in order to prevent misconnection with the receptacles, such coding arrangements do not insure that the plugs are connected to the receptacles in the desired sequence. Instructions for coupling the plugs to the receptacles are usually mounted adjacent to the receptacle assembly, but such instructions do not insure that the correct coupling sequence is used. There is therefore a need in the art to provide a coupling guard which forces an operator to couple a plurality of plugs to mating receptacles in the proper sequence.

SUMMARY AND OBJECTS OF THE INVENTION

A sequential coupling guard comprises a plurality of rotatable cam rings which are adjacent to and mesh with one another. The cam rings include cam surfaces which engage locking notches and clearance notches and enable the rings to be rotated only in a predetermined sequence. The cam rings are used in conjunction with plug and receptacle couplings in which the plug is rotated in the receptacle in order to complete the electrical connection thereto. Rotating the plugs rotates the cam rings; and unless the correct sequence is followed, the cam rings are locked against rotation. Once all the plugs have been connected, an opposite rotation required to disconnect the plugs from the receptacles and the accompanying opposite rotation of the cam ring is not possible unless the plugs are disconnected in the correct sequence. An alternate embodiment includes the use of cover plates, connected to the cam rings, which block access to the receptacles.

It is therefore an object of the invention to provide a coupling guard which insures the coupling of a plurality of plugs with plural receptacles in a predetermined sequence.

It is another object of the invention to provide a coupling guard in which a plurality of cam rings are used to control the sequence of connection of a plurality of plugs which must be rotated to make final electrical connection to the receptacle.

It is another object of the invention to provide a coupling guard which insures that the uncoupling of a plurality of plugs from a plurality of receptacles is performed in the correct sequence.

These and other objects of the invention will become apparent from the detailed description in which reference numerals used throughout the description correspond to reference numerals on the drawing figures.

DESCRIPTION OF THE PREFERRED EMBODIMENT

Figure 1:
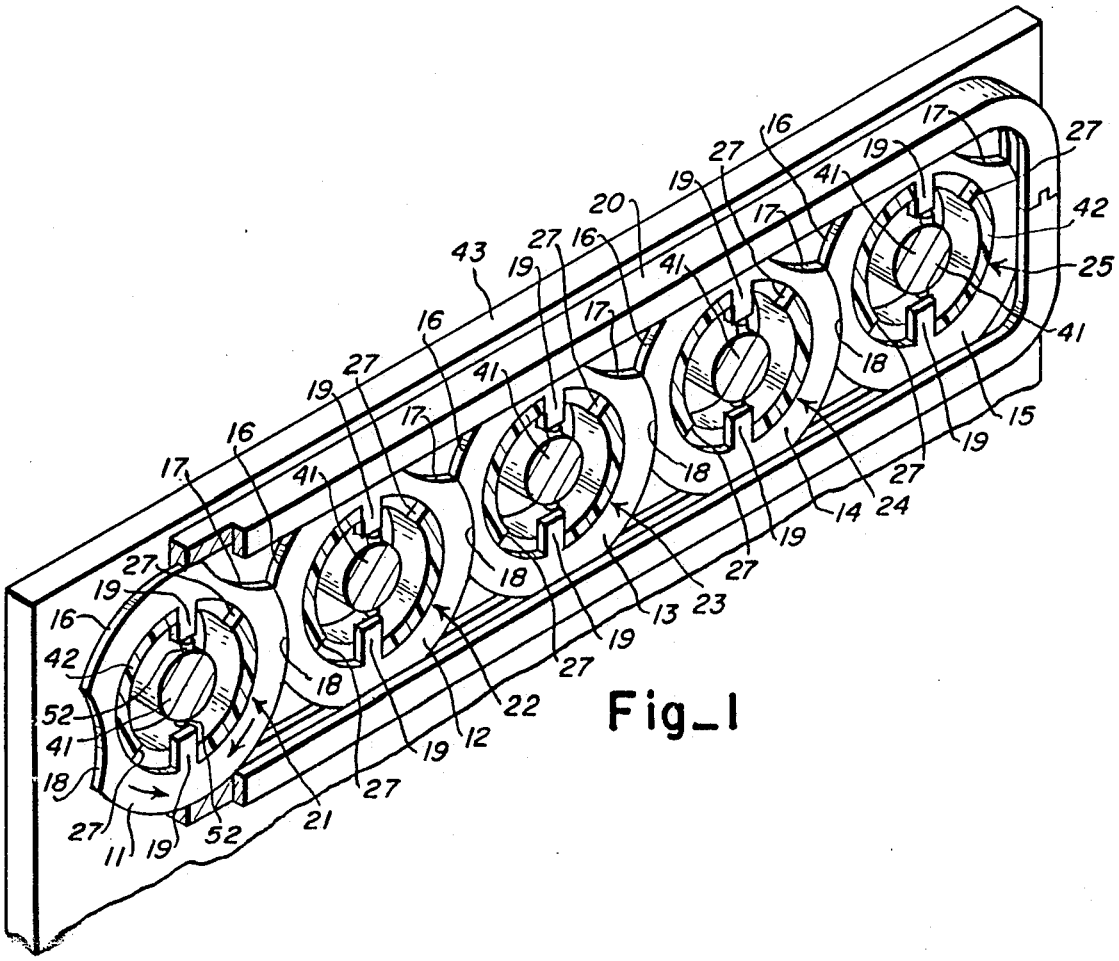
FIG. 1 is a perspective view of a plurality of cam rings and receptacles according to the invention.

Referring first to FIG. 1, there is shown a cam ring mechanism generally designated by the reference numeral 10. A plurality of cam rings 11–15 are mounted in an upper and lower channel member 20 and are arranged along a common axis 30 best seen in FIG. 2 which passes through the three and nine o'clock positions of each of the rings. The cam rings 11–15 are positioned at the rear of an array of electrical receptacles 21–25: the receptacle 21 may be a ground receptacle, the receptacle 22 may be a neutral receptacle, and the receptacles 23–25 may be for three-phase power. The receptacles are the type in which a plug must be twisted or rotated approximately 45° before making a final electrical connection thereto.

Each cam ring 11–15 includes an outer cam surface 16 which is generally convex in shape. The cam surface 16 does not extend completely around the cam ring and is subtended by a clearance notch 17 and a locking notch 18. The clearance notch 17 and the locking notch 18 are generally concave in shape and are dimensioned to mate with the convex cam surface 16 on an adjacent cam ring. The clearance notch 17 is located between the one and two o'clock position on each cam ring and the locking notch 18 is located at the nine o'clock position. Each cam ring includes a pair of tabs 19 which extend toward the center portion of the ring and provide engagement means for turning the cam ring as more fully described below. Rotation of each cam ring is limited by stops 27.

Figure 2:
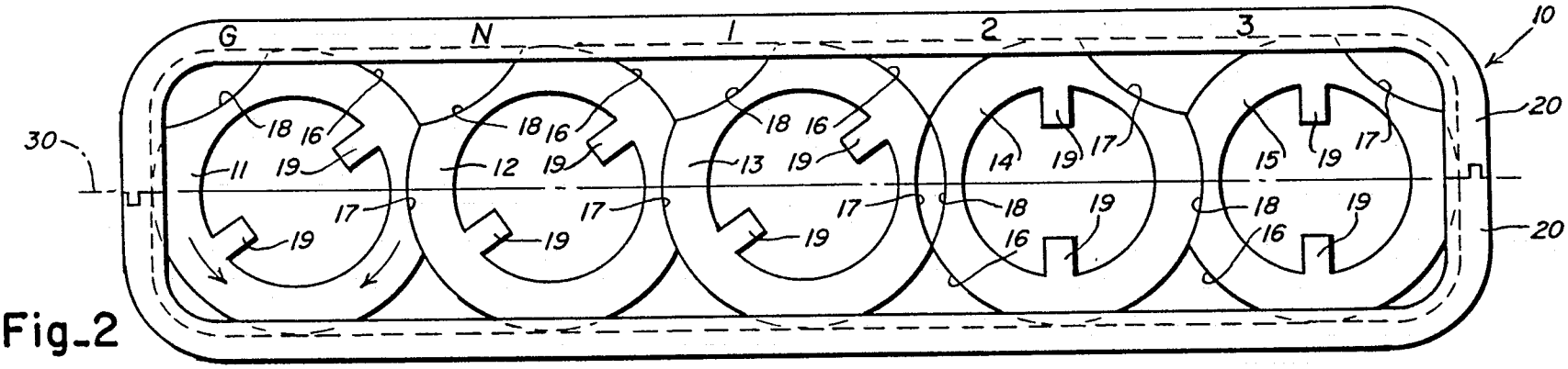
FIG. 2 is a front view of the plurality of cam rings of FIG. 1 after rotation of some of the rings.

In FIG. 1, each of the rings 11–15 is in an original, unrotated position. In FIG. 2, the first three rings 11–13 have been rotated clockwise as if an electrical connection has been made to the first three receptacles 21–23.

Figure 3:
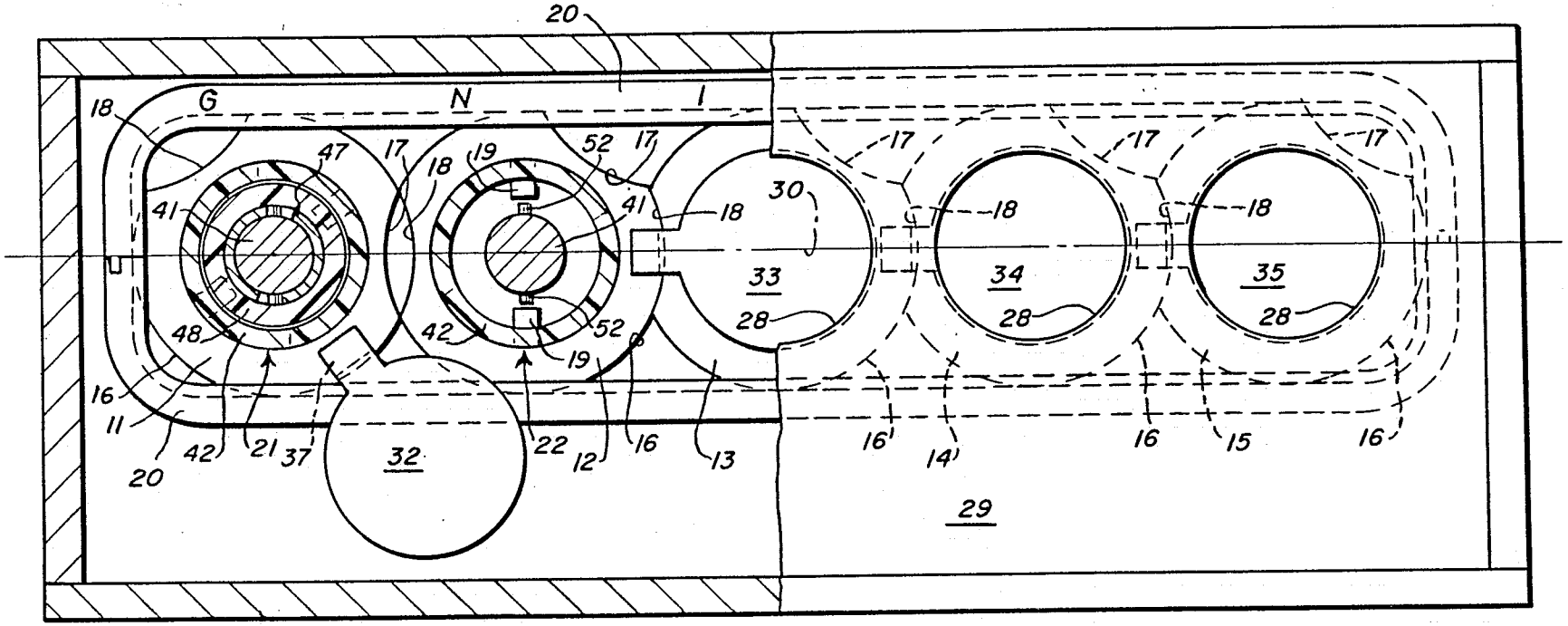
FIG. 3 is a partial front view of an alternate embodiment of the invention including cover plates which are connected to the cam rings.

FIG. 3 shows an alternate embodiment of the invention in which each of the receptacles 22–25 is positioned behind an aperture 28 in a front panel 29 and access to the apertures 28 is controlled by a cover plate 32–35, respectively. Each of the cover plates 32–35 is mechanically coupled to the cam ring adjacent and to the left of the receptacles 22–25; that is, cover 32 is coupled to the cam ring 11, cover 33 is connected to the cam ring 12, cover 34 is connected to the cam ring 13, and cover 35 is connected to the cam ring 14. The connection between the cam rings and the various covers 32–35 is made by a link 37 best seen in FIGS. 4 and 5. It will be noted that there is no cover plate over the first receptacle 21.

Figure 4:
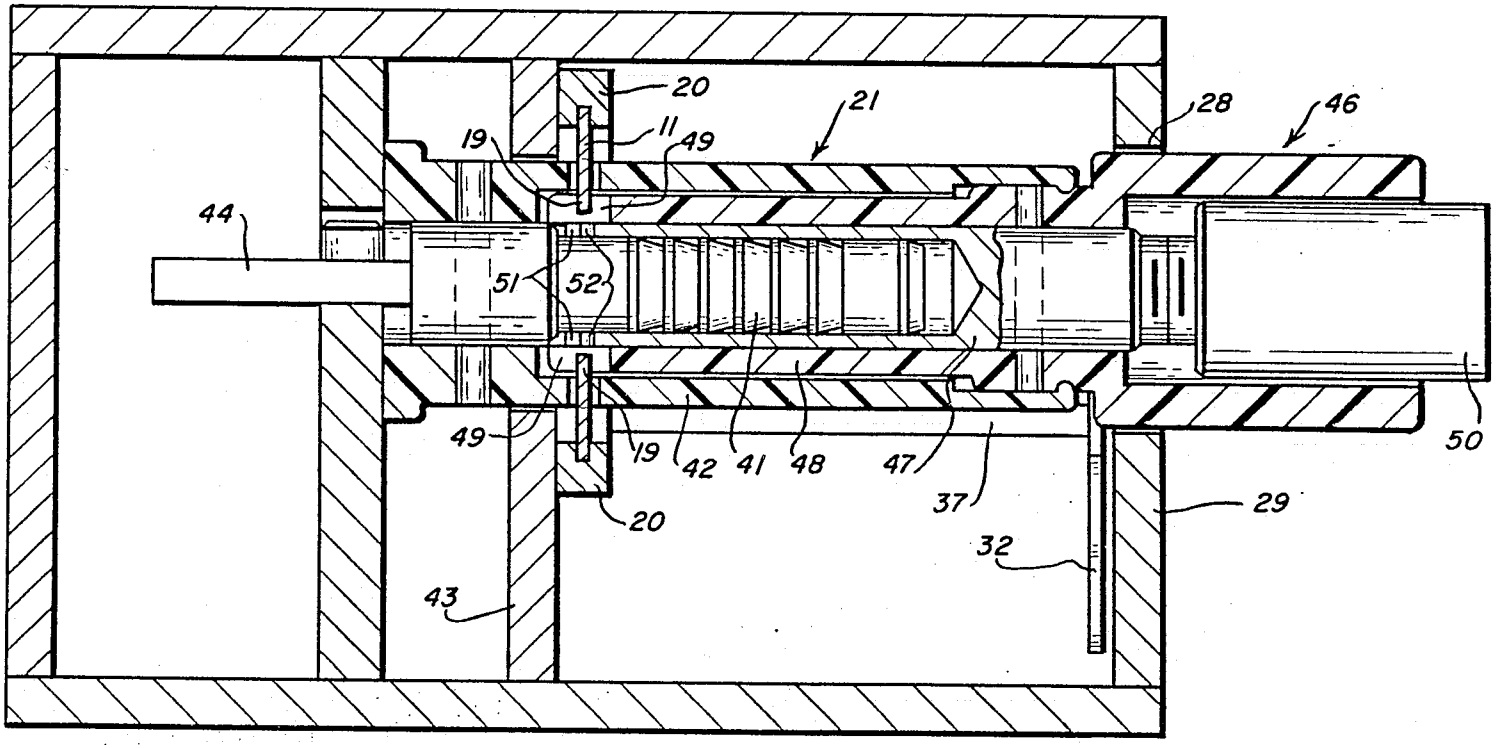
FIG. 4 is a side view of a receptacle with a plug attached thereto.

FIG. 4 shows a side view of the receptacle assembly 21 which comprises a conductive pin 41 and an insulating sleeve 42 which is spaced therefrom. The cover plate 32 which in one position blocks access to the adjacent receptacle 22 is shown rotated to an open position and is connected to the cam ring 11 by the link 37. The conductive pin 41 and the sleeve 42 are mounted on a support 43 and a coupling tab 44 extends from the rear of the pin 41 for connection to a cable or other conductive element as well known in the art.

A plug 46 comprises an electrical socket 47 and an insulating sheath 48 which are dimensioned to mate with the receptacle 21. The conductive socket 47 is coupled to a cable connector 50 which may be terminated #0 an electrical cable as well as known in the art. The forward portion of the insulating sheath 48 includes a pair of slots 49 which are dimensioned to receive the radially extending tabs 19 on the cam ring. The forward portion of the socket 47 includes two L-shaped slots 51 best seen in FIG. 5 which receive two oppositely directed locking pegs 52 on the rear portion of the pin 41. When the socket 47 is fully engaged with the pin 41, the locking pegs 52 are at the bottom of the respective L slots 51; and the socket 47 may be rotated clockwise to position each of the locking pegs 52 in the foot 53 of the respective slot 51 to lock the socket onto the pin 41. Rotation of the socket also rotates the cam ring through the engagement of the tabs 19 in the slots 49. The rotation of the cam ring is limited by the abutment of the tabs 19 against the stops 27.

MODE OF OPERATION

The coupling guard controls the sequence of connecting a plurality of plugs to a plurality of receptacles as explained below.

Referring first to FIG. 1, the cam ring 11 which surrounds the ground receptacle 21, may turn either clockwise or counterclockwise since the cam surface 16 is free to turn relative to the locking notch 18 on the cam ring 12. The cam ring 12 is not free to turn, however, since the locking notch 18 is in an abutting relationship with the cam surface 16 of the cam ring 11. In a similar way, the locking notch 18 of each of the cam rings 13–15 is in abutting relationship with the cam surface 16 of the cam ring to the immediate left. Rotating the cam ring 11 clockwise approximately 45° will abut the tabs 19 against the stops 27 and will position the clearance notch 17 of the cam ring 11 adjacent the cam ring 12. In this position, the cam ring 12 is free to rotate since the cam surface 16 of the ring 12 will pass through the clearance notch 17 of the cam ring 11. After the cam ring 12 has been rotated clockwise approximately 45°, the clearance notch 17 of cam ring 12 will be adjacent the cam ring 13. This will allow the cam ring 13 to be rotated; and in a similar fashion, the cam rings 14 and 15 may likewise be rotated once the cam ring immediately adjacent and to the left has been rotated clockwise to position the clearance notch 17 adjacent the cam ring which is next to be rotated.

Figure 5:
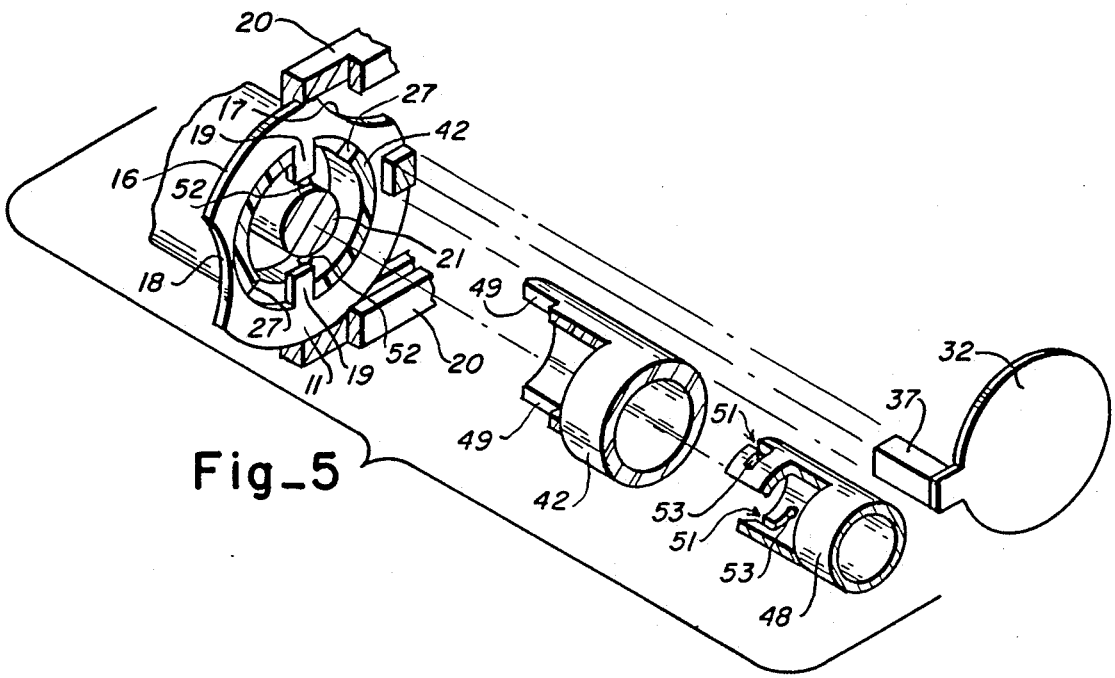
FIG. 5 is an exploded perspective view of a locking mechanism for a pin and socket connector.

In the manner described above, a series of plugs which must be rotated to couple with a series of receptacles can only be connected to the receptacles 21–25 in sequence from left to right. Engagement means on the cam rings such as the tabs 19 may be used to interlock with a plug which is inserted into the receptacle and to turn in response to a rotation of the plug. The clockwise rotation of the plug and the cam ring allows the adjacent cam ring to the right to be turned and thus the sequence of connections to be made. Plug and receptacle connectors such as shown in FIGS. 4 and 5 which require a partial turn or twist in order to make final electrical connection to a receptacle are well known in the art. Such connectors can be used with the apparatus of FIG. 1 with the result that the several plugs will have to be coupled to the plural receptacles in the predetermined sequence.

The apparatus of FIG. 1 will also insure that the disconnection of the several plugs is made in the correct sequence. As shown in FIG. 2, once the cam rings 12 and 13 have been rotated 45° clockwise, the cam surface 16 of the cam rings 12 and 13 engages the clearance notch 17 of the cam rings 11 and 12, respectively. As a result, the cam rings 11 and 12 are locked against rotation; and cam ring 13 must be rotated counterclockwise to align the locking notch 18 of the cam ring 13 with the cam ring 12. Once this alignment has been made, it will be possible to rotate the cam ring 12 counterclockwise to align the locking notch of the ring 12 with the cam ring 11. Thus, the rings as shown in FIG. 2 may be rotated 45° clockwise one at a time starting with the ring 13 in order to disengage the peg and L-slot lock and release the plugs from the receptacles 23, 22, and 21. If plugs have been connected to all five receptacles, the plugs coupled to the three power receptacles 23, 24, and 25 must be disconnected before the plug coupled to the neutral receptacle 22 or the plug coupled to the ground receptacle 21 can be disconnected.

In a further embodiment of the invention, the cover plates as shown in FIGS. 3 and 4 are used to block access to the receptacles in order to further insure that the connections are made to the receptacles in the proper sequence. As shown in FIG. 3, the receptacles 23–25 are located behind apertures 28 in the front panel 29 which may be blocked by the cover plates 33–35. The cover plates are attached by a link 37 to the cam ring immediately to the left of the receptacle over which the cover plate is located. The cover plate 32 for receptacle 22 has been rotated out of the way by rotating the cam ring 11 clockwise. As shown in conjunction with FIG. 4, slots 49 may be provided in the sheath 48 around the socket 47 to engage the tabs 19 and turn the cam ring 11. Once the receptacle 22 has been uncovered, as shown in FIG. 3, a plug may be inserted into the receptacle 22 and the plug turned clockwise to slide the cover plate 33 away from the receptacle 23. The complete connection to the five receptacles 21–25 may be made using the same sequence always rotating a cam ring to the left of a receptacle in order to slide the cover plate away from that receptacle. Once a connection has been made to any or all of the receptacles in a proper sequence, the reverse sequence must be used to disconnect the plugs as more fully explained above. Although panels having five receptacles have been shown in the various embodiments, the invention is equally applicable to panels having other numbers of receptacles. The invention is also applicable to installations in which the receptacles comprise socket connectors, and the plugs comprise pin connectors.

Having thus described the invention, various alterations and modifications will be apparent to those skilled in the art, which alterations and modifications are intended to be within the scope of the present invention as defined by the appended claims.

What is claimed is:

1. A coupling guard which insures the coupling of a plurality of plugs and receptacles in a predetermined sequence in which the plugs must be rotated in one direction to complete an electrical connection to the receptacle and rotated in the opposite direction to break the electrical connection, the coupling guard comprising:

first and second receptacles;

first and second cam rings surrounding the first and second receptacles;

a first cam surface having a convex shape and a first clearance notch on the outer surface of the first cam ring;

a second cam surface and a locking notch on the outer surface of the second cam ring the locking notch having a concave shape which is complimentary to the shape of said first cam surface, wherein the cam surface of the first cam ring prevents rotation of the second cam ring when the first cam surface engages the locking notch of the second cam ring, and wherein the second cam ring is free to turn when the first clearance notch engages the second cam surface on the second cam ring; and wherein the second cam surface engages the first clearance notch when the second cam ring rotates and prevents rotation of the first cam ring without first rotating the second cam ring to remove the second cam surface of the second cam ring from the clearance notch of the first cam ring.

2. The coupling guard of claim 1 wherein the first cam surface has the shape of a segment of a circle.

3. The coupling guard of claim 2 further comprising:

engagement means on the first and second cam rings for engaging the plurality of plugs.

4. The coupling guard of claim 3 wherein the engagement means transfers rotation of the plugs to the cam rings.

5. The coupling guard of claim 4 wherein the engagement means comprise tabs which project from the inside diameter of the cam rings.

6. The coupling guard of claim 1 further comprising:

a first cover plate coupled to the first cam ring and rotatable therewith, wherein the first cover plate may be positioned to cover the second receptacle.

7. The coupling guard of claim 6 further comprising:

a third cam ring which is substantially similar to the second cam ring, wherein the centers of the first, second, and third cam rings lie on a straight line.

8. The coupling guard of claim 7 further comprising:

a second cover plate coupled to the second cam ring and rotatable therewith, wherein the second cover plate may be positioned to cover a third electrical receptacle.

9. A coupling guard for controlling the rotation of a series of cam rings in conjunction with the rotation of a series of plugs which must be rotated when being coupled or uncoupled with a series of receptacles comprising:

a first and second cam ring;

a cam surface at the three o'clock position on each cam ring;

a clearance notch between the one and two o'clock positions on each cam ring; and a locking notch at the none o'clock position on each cam ring, wherein engagement of the cam surface of the first cam ring with the locking notch of the second cam ring prevents rotation of the second cam ring.

10. The coupling guard of claim 9 wherein clockwise rotation of the first cam ring positions the clearance notch of the first cam ring adjacent the locking notch of the second cam ring allowing rotation of the second cam ring.

11. The coupling guard of claim 10 further comprising:

engagement means on the first and second cam rings for rotating the cam rings.

12. The coupling guard of claim 9 further comprising:

a third cam ring adjacent the second cam ring and substantially the same as the first and second cam rings.

13. The coupling guard of claim 11 wherein the first, second, and third cam rings are arranged along a common axis which passes through the three and nine o'clock positions of each of the rings.

14. The coupling guard of claim 12 wherein the first cam ring must be rotated clockwise before the second cam ring can be rotated clockwise, and the second cam ring must be rotated clockwise before the third cam ring can be rotated clockwise.

15. The coupling guard of claim 14 wherein rotation of the second cam ring causes the cam surface of the second cam ring to engage the clearance notch of the first cam ring and rotation of the third cam ring causes the cam surface of the third cam ring to engage the clearance notch of the second cam ring, whereby the first cam ring cannot be rotated counterclockwise before rotating the second cam ring counterclockwise, and the second cam ring cannot be rotated counterclockwise before the third cam ring is rotated counterclockwise.

16. The coupling guard of claim 13 further comprising:

fourth and fifth cam rings which are substantially the same as the first, second, and third cam rings, wherein the five cam rings are all arranged along a common axis.

17. A coupling guard which insures the coupling of ground, neutral, and power plugs to plural receptacles in a predetermined sequence comprising:

a plurality of cam rings one for each of the ground, neutral, and power receptacles;

a concave cam surface on each cam ring and a concave clearance notch on the ground and neutral cam rings; and a concave locking notch on the neutral and power cam rings, whereby the neutral and power cam rings may be locked against rotation, and whereby the neutral cam ring may be rotated clockwise only after clockwise rotation of the ground cam ring and the power cam ring may be rotated clockwise only after clockwise rotation of the neutral ground ring.

18. The coupling guard of claim 17 wherein clockwise rotation of the neutral cam ring prevents counterclockwise rotation of the ground cam ring and clockwise rotation of the power cam ring prevents counterclockwise rotation of the neutral cam ring.

19. The coupling guard of claim 18 further comprising:

means on the cam rings for engaging the ground, neutral, and power plugs, whereby rotation of the plugs causes a rotation of the ring.

20. The coupling guard of claim 19 further comprising:

a first cover plate coupled to the first cam ring and a second cover plate coupled to the second cam ring, wherein clockwise rotation of the first cam ring removes the first cover plate from a blocking position across the neutral receptacle and wherein clockwise rotation of the second cam ring removes the second cover plate from a blocking position across a power receptacle.

* * * * *